US009623280B2

(12) United States Patent
Justice Velasco

(10) Patent No.: US 9,623,280 B2
(45) **Date of Patent: *Apr. 18, 2017**

(54) ROLLER BARRE

(71) Applicant: Absolutely Fitness, LLC, South Jordan, UT (US)

(72) Inventor: Pamela S. Justice Velasco, South Jordan, UT (US)

(73) Assignee: ABSOLUTELY FITNESS, LLC, South Jordan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/867,588

(22) Filed: Sep. 28, 2015

(65) Prior Publication Data

US 2016/0016034 A1 Jan. 21, 2016

Related U.S. Application Data

(63) Continuation of application No. 14/107,332, filed on Dec. 16, 2013, now Pat. No. 9,149,410.

(Continued)

(51) Int. Cl.
*A63B 21/00* (2006.01)
*A63B 26/00* (2006.01)

(Continued)

(52) U.S. Cl.
CPC ..... *A63B 22/0089* (2013.01); *A61H 15/00* (2013.01); *A63B 26/00* (2013.01);

(Continued)

(58) Field of Classification Search
CPC ..... A63B 21/00185; A63B 21/0023; A63B 21/1476; A63B 21/1496; A63B 21/015;

(Continued)

(56) References Cited

U.S. PATENT DOCUMENTS 1,780,479 A * 11/1930 Griffith ..... A61H 15/00 482/79
1,982,872 A * 12/1934 Husted ..... A63B 22/0076 482/72

(Continued)

FOREIGN PATENT DOCUMENTS

GB 260426 11/1926
JP 3165561 1/2011

OTHER PUBLICATIONS

Non-final office action dated Jul. 31, 2015 for U.S. Appl. No. 14/107,332.

(Continued)

*Primary Examiner* — Joshua Lee
(74) *Attorney, Agent, or Firm* — Snell & Wilmer L.L.P.

(57) ABSTRACT

The present disclosure provides an exercise device comprising a base that is attached onto an exercise machine and a rolling rod, which is cradled into the base. The apparatus can be attached either into the jumpboard connection located near the footbar or into the shoulder rests depending on the reformer model. The attachment site allows the user to perform a wide variety of movements or exercises in a manner depending on level or special considerations. Related methods of exercise are also provided. A DVD, instructional manual, or programming exercises may optionally be included.

17 Claims, 7 Drawing Sheets

Related U.S. Application Data

(60) Provisional application No. 61/738,898, filed on Dec. 18, 2012.

(51) Int. Cl.
*A63B 22/00* (2006.01)
*A61H 15/00* (2006.01)

(52) U.S. Cl.
CPC ..... *A61H 2015/0014* (2013.01); *A61H 2201/1261* (2013.01); *A61H 2201/1284* (2013.01); *A61H 2201/1671* (2013.01)

(58) Field of Classification Search
CPC ..... A63B 21/4015; A63B 21/4049; A63B 22/0087; A63B 22/0089; A63B 22/20; A63B 22/201; A63B 22/205; A63B 22/208; A63B 26/00; A63B 1/00; A63B 1/005; A63B 4/00; A61H 15/00; A61H 2201/1261; A61H 2201/1284; A61H 2201/1671; A61H 2015/0014; A61H 2015/0021; A61H 2015/0057
See application file for complete search history.

(56) References Cited

U.S. PATENT DOCUMENTS 2,123,765 A * 7/1938 Broberg ..... A61H 15/00 601/122
2,129,262 A * 9/1938 Cole ..... A63B 22/205 482/132
2,582,686 A * 1/1952 Fabio ..... A61H 15/00 601/118
2,638,089 A * 5/1953 Murphy ..... A61H 15/00 601/118
2,663,293 A * 12/1953 Elliott ..... A61H 15/0078 601/121
2,931,648 A * 4/1960 Davies ..... A63B 26/003 472/127
3,106,395 A * 10/1963 Birkenbeul ..... A61H 15/00 482/132
3,164,150 A * 1/1965 Reid ..... A61H 15/0078 482/135
3,633,905 A * 1/1972 Etchelecou ..... A63B 26/003 472/127
3,845,952 A * 11/1974 McKinney ..... A63B 21/008 472/127
3,887,179 A * 6/1975 Klepper ..... A63B 26/003 472/127
4,142,519 A * 3/1979 Ferguson ..... A61H 15/00 601/118
4,522,391 A * 6/1985 Rundall ..... A61H 1/0218 482/144
5,478,034 A * 12/1995 Cunningham ..... A47B 21/0371 248/118.5
5,643,143 A * 7/1997 Burak ..... A63B 71/0009 482/54
5,772,614 A * 6/1998 Lindquist ..... A63B 21/00061 601/116
6,071,253 A * 6/2000 Rivera ..... A61H 1/0292 601/118
6,811,539 B1 * 11/2004 Nguyen ..... A61H 23/02 601/27
6,974,427 B1 * 12/2005 Lapham ..... A61H 15/00 601/120
9,011,356 B2 * 4/2015 McClorey ..... A61H 15/00 601/122
2005/0049532 A1 * 3/2005 Lee ..... A61H 15/00 601/118
2007/0015645 A1 * 1/2007 Hale ..... A63B 21/4015 482/140
2011/0230804 A1 * 9/2011 Serhan ..... A61H 15/0085 601/112
2011/0237987 A1 * 9/2011 Du ..... A61H 15/00 601/24

OTHER PUBLICATIONS

Notice of Allowance dated Sep. 2, 2015 for U.S. Appl. No. 14/107,332.

* cited by examiner

ROLLER BARRE

CROSS-REFERENCE TO RELATED APPLICATION

This application claims priority to U.S. patent application Ser. No. 14/107,332 filed Dec. 16, 2013 and entitled "Roller Barre," which claims priority to U.S. Provisional Patent Application Serial No. 61/738,898 filed on Dec. 18, 2012 and entitled "Reformer Roller Barre," which are incorporated herein by reference in their entirety.

BACKGROUND

Field

This disclosure relates to exercise equipment, more particularly to the field of foam rolling. More specifically, the disclosure relates to a foam roller apparatus attachment usable with an exercise machine.

Discussion of the Related Art

The prior art involves the use of non-fixed rollers and rollers which require significant manual dexterity and strength to be used safely and effectively. Currently, there are many prior art foam rollers. Most of these are comprised of a thick, compressed foam core. One example of a prior art foam roller is the traditional foam roller which is generally 6 inches in diameter by 36 inches long and comes is the shape of a cylinder. In order to use the roller, the exerciser must lower oneself down to the floor and move one's body across the top of the roller. This type of rolling poses some risks for individuals who have problems getting up and down off the floor due to injuries, age, or special needs. Furthermore those who have wrist or shoulder issues and are unable to hold themselves up in order support their own body weight can be unable to perform this type of rolling. Without sufficient strength, balance and pressure, the roller may slip out from underneath one's body.

Another example of a prior art foam roller is a small hand-held cylinder similar to a rolling pin. This roller requires the exerciser to use both hands to hold onto the device and roll it on top of a body part. Products range in lengths from about 18 to 30 inches which, in some exercise environments where many machines are co-located, is inconveniently large for a roller that is not attached to a user's machine, particularly when some exercisers are using rollers and others are using machines, simultaneously. Again, this type of rolling poses some risks for individual who have shoulder, wrist or back issues. For example, in order to roll it on top of one's back, a user must be able to bring both hands behind one's back in an oppositional manner and must have full range of motion and flexibility in both shoulders. An individual seeking to use a foam roller on his or her back often lacks these abilities.

In both of the previous examples of prior art foam rollers, the roller is in a non-fixed position. Unfortunately, this position poses potential problems such as hindering the correct alignment of the lower back, shoulders, and wrists and can be unsuitable for those with lower back, shoulder, elbow, or wrist issues.

Moreover, in most Pilates studios there is generally not enough floor space in between each reformer to place a mat on the floor along with the traditional 3 foot foam roller. Lying on the floor in this configuration would require approximately 4 feet in between each reformer so that the user has adequate space to use the roller to avoid injury from accidently hitting the reformer side rails. Currently, there is no way to use a foam roller while on the reformer, and even when the reformer is used with a mat converter, the traditional foam roller is about a foot wider than the reformer which can cause displacement of the roller since due to its wider width.

SUMMARY

The present disclosure is not limited to the following description. The following is meant merely as a brief summary of the general features of illustrative embodiments of the exercise apparatus of the present disclosure.

The present disclosure fulfills a need for a foam roller that can be adaptably fixed to an exercise machine and that allows an exerciser to exercise with greater safety and in smaller spaces. This disclosure seeks to provide an improved apparatus for foam rolling that allows a user to attach the roller to a fixed position which is then attached to an exercise machine. This allows the exerciser to move one's body across the roller by simply moving the carriage of the exercise machine away from the apparatus via the use of the exercise machine's spring tension. The apparatus can also be used without resort to an exercise machine's spring tension by a user who uses gravity and muscle strength to apply the desired amount of pressure from a comfortable position. It also provides a safer means of rolling for all users and allows users to complete an exercise routine in a smaller space by combining the foam roller portion of the user's exercise routine with the exercise machine portion of the user's exercise routine.

Moreover, attaching a foam roller to an exercise machine facilitates group exercise, such as in Pilates classes. This disclosure eliminates the use of mats and decreases required floor space. Additionally, it provides for quicker transitions between exercises since there is no need to get on and off the reformer in order to incorporate foam rolling. Quicker and smoother transitions enable the user to accomplish all fitness goals/exercises from start to finish. For example, an exerciser may use the roller for myofascial compression technique or dynamic stretching to conduct a warm-up. Then an exerciser may use the roller to perform correct exercise modifications and progressions during the workout, such as in rehabilitation to advanced stability training. Lastly, the exerciser may use the roller for self-myofascial release and static stretching during a cool down.

Thus, it is an object of this disclosure to provide a rolling apparatus which can be attached to an exercise machine, and that can be used for multiple applications such as, but not limited to myofascial compression technique, self-myofascial release, stretching, stability training, rehabilitation, and exercise progression providing myriad exercises and movements in all planes of motion and adaptable for use in conjunction with any reformer exercise machine.

In accordance with an illustrative embodiment, an apparatus is presented for foam rolling adaptable for use in a Pilates studio or reformer classes where floor space is limited, safety is critical, correct alignment is essential, and where modifications can be made to include exercisers of all fitness levels including those with injuries and special populations, such as the elderly or pregnant.

In accordance with various embodiments, an exercise device of the present disclosure comprises a base with attached handles that houses the roller in a fixed position and a moving roller bar over which a variety of foam cylinders can be placed. Various embodiments may include variations in the shape, material, construction method, attachment methods, and size of the base frame, handles, and rolling bar.

Various embodiments may further include changeable attachment mechanisms for use with different exercise machines. For example, this device can be inserted using the appropriate attachment for the specific type of exercise machine into the jumpboard site near the footbar or into the shoulder rest sites on the carriage, providing various benefits for the exerciser.

In accordance with various embodiments, a roller barre device is disclosed. In accordance with various embodiments, a roller barre device has a base, a roller, a first post affixed to the base and having a first housing cradle, and a second post affixed to the base and having a second housing cradle, wherein the roller fits within the first housing cradle and the second housing cradle thereby being maintained in mechanical communication with the first post and the second post.

In accordance with various embodiments, a roller may have a support rod, and a rolling bar having an aperture wherein the support rod extends through the aperture. Moreover, in accordance with various embodiments, a roller may alternatively have a support rod, a first rolling bar having a first aperture wherein the support rod extends through the first aperture, and a second rolling bar having a second aperture wherein the support rod extends through the second aperture. Still furthermore, a roller may have a first support rod, a second support rod, a first rolling bar having a first aperture wherein the first support rod extends through the first aperture, and a second rolling bar having a second aperture wherein the second support rod extends through the second aperture.

In accordance with various embodiments, a post may have a rotational locking pin whereby the roller may be securely mounted in position, and a rotation limiting insert whereby the degree of rotation of the roller bar may be limited.

In accordance with various embodiments, a method of assembling a roller barre device is also disclosed. In accordance with various embodiments, a method of assembling a roller barre device includes assembling a roller, wherein the assembling includes inserting a support rod into a first rolling bar, wherein the first rolling bar includes an aperture wherein the support rod may be inserted, positioning the roller in mechanical communication with a first post having a first housing cradle and a second post having a second housing cradle, wherein the first post and the second post are affixed to a base, and wherein the roller is positioned in the first housing cradle and the second housing cradle, attaching at least one insert in mechanical communication with the base, and attaching the insert to an exercise machine.

In accordance with various embodiments, assembling a roller may include inserting the support rod into a second rolling bar, wherein the second rolling bar includes an aperture wherein the support rod may be inserted.

In accordance with various embodiments, assembling a roller barre device may further include inserting a first rotational locking pin into the first post whereby the roller may be securely mounted in position, and placing a rotation limiting insert in the first housing cradle of the first post, and limiting the degree of rotation of the first rolling bar.

Alternatively, in accordance with various embodiments, assembling a roller barre device may include inserting a first rotational locking pin into the first post whereby the first rolling bar may be securely mounted in position, placing a rotation limiting insert in the first housing cradle of the first post, limiting the degree of rotation of the first rolling bar, inserting a second rotational locking pin into the second post whereby the second rolling bar may be securely mounted in position, placing a rotation limiting insert in the second housing cradle of the second post, and limiting the degree of rotation of the second rolling bar.

Moreover, in accordance with various embodiments, an exercise system is disclosed. An exercise system may include a roller barre device, and an exercise machine wherein the roller barre device and the exercise machine are connected in mechanical communication. In various embodiments, the exercise machine is a Pilates reformer.

These and other features and advantages of the present disclosure will become apparent to a person having ordinary skill in the art from the following description and accompanying drawings.

BRIEF DESCRIPTION OF THE DRAWINGS

A person having ordinary skill in the art will understand that the drawings, described below, are for illustration purposes only. Furthermore, the drawings are not intended to limit the scope of the present disclosure or teachings in any way.

The accompanying drawings are included to provide a further understanding of the disclosure and are incorporated in and constitute a part of this specification, illustrate embodiments of the disclosure, and together with the description serve to explain the principles of the disclosure, in which like numerals denote similar elements and.

DETAILED DESCRIPTION OF THE ILLUSTRATED EMBODIMENTS

Figure 1:
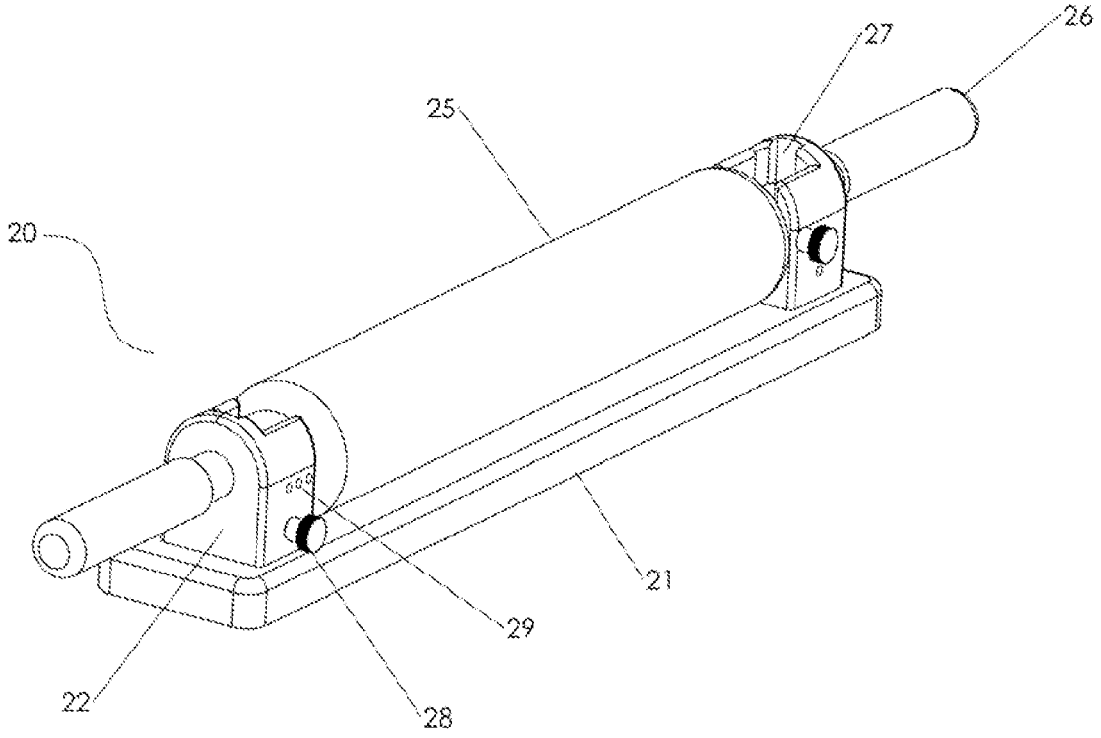
FIG. 1 illustrates a perspective view of an embodiment.

Persons skilled in the art will readily appreciate that various aspects of the present disclosure can be realized by any number of methods and systems configured to perform the intended functions. Stated differently, other methods and systems can be incorporated herein to perform the intended functions. It should also be noted that the accompanying drawing figures referred to herein are not all drawn to scale, but can be exaggerated to illustrate various aspects of the present disclosure, and in that regard, the drawing figures should not be construed as limiting. Finally, although the present disclosure can be described in connection with various principles and beliefs, the present disclosure should not be bound by theory.

The following description is of various illustrative embodiments only, and is not intended to limit the scope, applicability or configuration of the present disclosure in any way. Rather, the following description is intended to provide a convenient illustration for implementing various embodiments including the best mode. As will become apparent, various changes can be made in the function and arrangement of the elements described in these embodiments without departing from the scope of the appended claims.

For the sake of brevity, conventional techniques for manufacturing and construction may not be described in detail herein. Furthermore, the connecting lines shown in various figures contained herein are intended to represent illustrative functional relationships and/or physical couplings between various elements. It should be noted that many alternative or additional functional relationships or physical connections can be present in a practical method of construction.

Now, with reference to FIG. 1, in accordance with an embodiment, the present disclosure discloses a roller barre 20. Roller barre 20 includes a base 21, a first post 22 attached to base 21, by, for example, welds, and comprising a first housing cradle 27, a second post 22 attached to base 21, by, for example, welds, and comprising a second housing cradle 27, and a roller comprising a rolling bar 24, and a support rod 23 over which the rolling bar 24 slides. The roller is fixed into position by the housing cradles 27. While the housing cradles 27 as shown in FIG. 1 are open in the vertical direction to cradle rolling bar 24, the housing cradles 27 can be open to cradle rolling bar 24 in an off-vertical direction of up to about 90 degrees. In accordance with various embodiments, an off-vertical direction of 90 degrees means a housing cradle 27 is open in the horizontal direction to cradle rolling bar 24. In various embodiments, the vertical direction is a direction extending normal to a surface plane of the base. In various embodiments, the horizontal direction is a direction extending parallel to a surface plane of the base. Also affixed to the posts 22 are handles 26, by, for example, welds. Underneath base 21 are attachment inserts (shown more clearly in FIG. 3 and will be further explained later) so that roller barre 20 can be securely attached to an exercise machine. In this manner, an insert may be connected in mechanical communication with the base and extend substantially normal to a plane of the base 21, whereby the roller barre 20 maybe attached to an exercise machine.

As used herein the term "exercise machine" means any structure that is conventionally used, or that may be suitable used in connection with any form of exercise, such as a Pilates reformer, Stability Chair (Merrithew Health & Fitness, Ontario, Canada), Cadillac (Merrithew Health & Fitness, Ontario, Canada), ballet barre, basic mat, bench, cage, chair, or the like.

Base 21 of roller barre 20 may vary in height to accommodate for neck and back positions and comfort. The edges of base 21 can be beveled or rounded for safety or aesthetic purposes. Additionally, the bottom of base 21 may have attached high traction grip pads to prevent slippage or movement when roller barre 20 is used in conjunction with other Pilates equipment, like the Stability Chair (Merrithew Health & Fitness, Ontario, Canada), Cadillac (Merrithew Health & Fitness, Ontario, Canada), or on the floor if used with a ballet barre or a basic mat.

Figure 2:
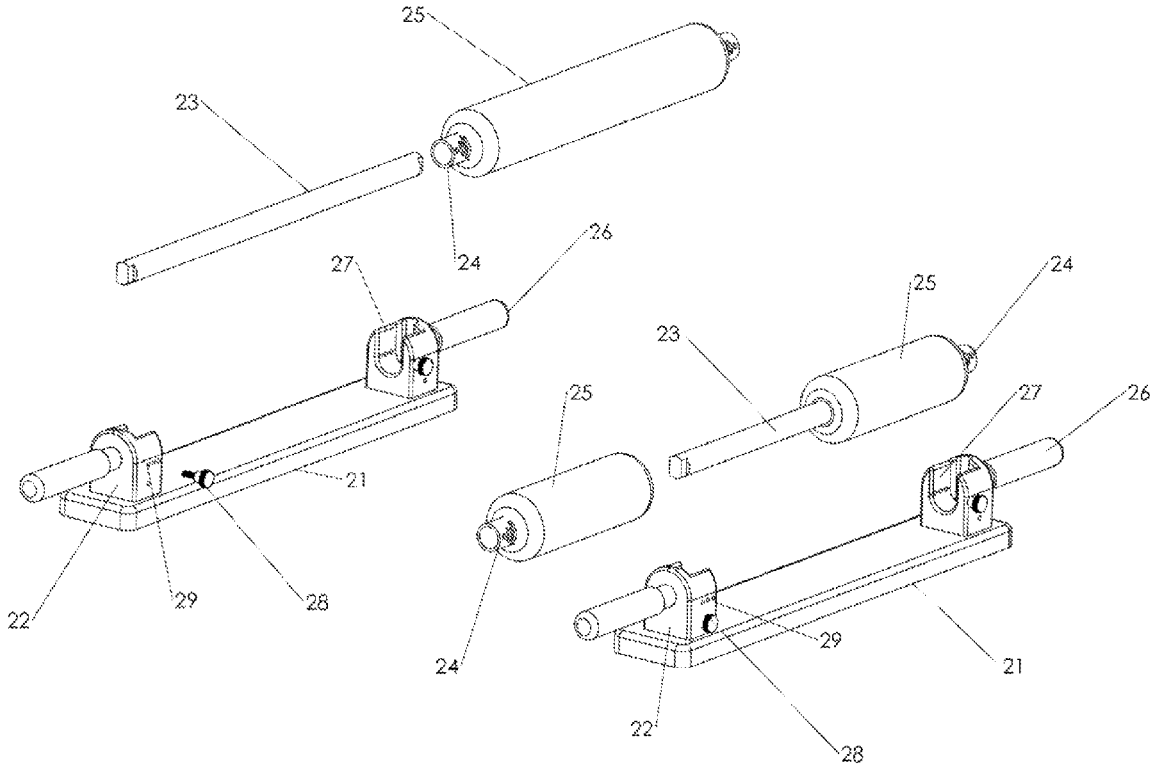
FIG. 2 illustrates an exploded view an embodiment with single and dual/split roller.

Referring now to FIG. 2, in accordance with an embodiment, the support rod 23 can be lifted away from its housing cradle 27 so that it may support a solid or split rolling bar 24 using various types of hollowed foam rollers or split rollers (2 smaller independent foam rollers) 25, ranging in density, softness, texture, and/or materials that can be cooled or heated can be placed over the rolling bar 24. Since the core of the foam roller 25 has an aperture (e.g., is hollow) in order to slide over the rolling bar 24, the rolling bar 24 keeps the foam from being compressed over time. Moreover, since rolling bar 24 has an aperture (e.g., is hollow) in order to slide over the support rod 23, support rod 23 may provide rigidity to rolling bar 24. Support rod 23 can be varied in material, size, and configuration in order for use with individuals of different size and weight, for example, in an embodiment, support rod 23 can withstand at least about 250 pounds of weight or more. The rolling bar 24 may also be designed so that each half/side of the rolling bar 24 moves independently and thus so that split rollers 25 move independently. For example, a dual or split rolling bar 24 can allow users to work unilaterally on one leg or arm while resting the other limb in a supported position, in either a locked or unlocked housing cradle 27. Additionally, a split or dual rolling bar 24 can allow for a user to work reciprocally or bilaterally, but yet independently with the periphery. Thus, in various embodiments, there may be a first and a second rolling bar 24 associated with a support rod 23. In various embodiments, there may be a first rolling bar 24 associated with a first support rod 23 and a second rolling bar 24 associated with a second support rod 23. In other words, either or both of the rolling bar and support rod may be split so that each half/side moves independently.

In accordance with yet another embodiment, and with reference to FIG. 2, the posts 22 house rotational locking pins 28 and rotation limiting inserts 29 on the front or back of one or both posts 22, to control the range of motion allowing the user to control the degree of rotation using the rotational threads located on the distal ends of the rolling bar 24, from no rolling/locked position (for myofascial compression), smaller degrees of rotation, e.g., about 45 to about 90 degrees (for rehab clients who need less range of motion or may need help in stabilizing), to larger ranges of motion (e.g., about 180 to about 360 degrees) for advanced users. Multiple rotational locking pins and/or rotation limiting inserts may be implemented, for example, to permit, in accordance with various embodiments having a dual or split rolling bar arrangement, each half/side to be controlled independently. Electrical components can be added to the posts 22 to allow for vibration, heating or cooling of the rolling bar 24.

Figure 3:
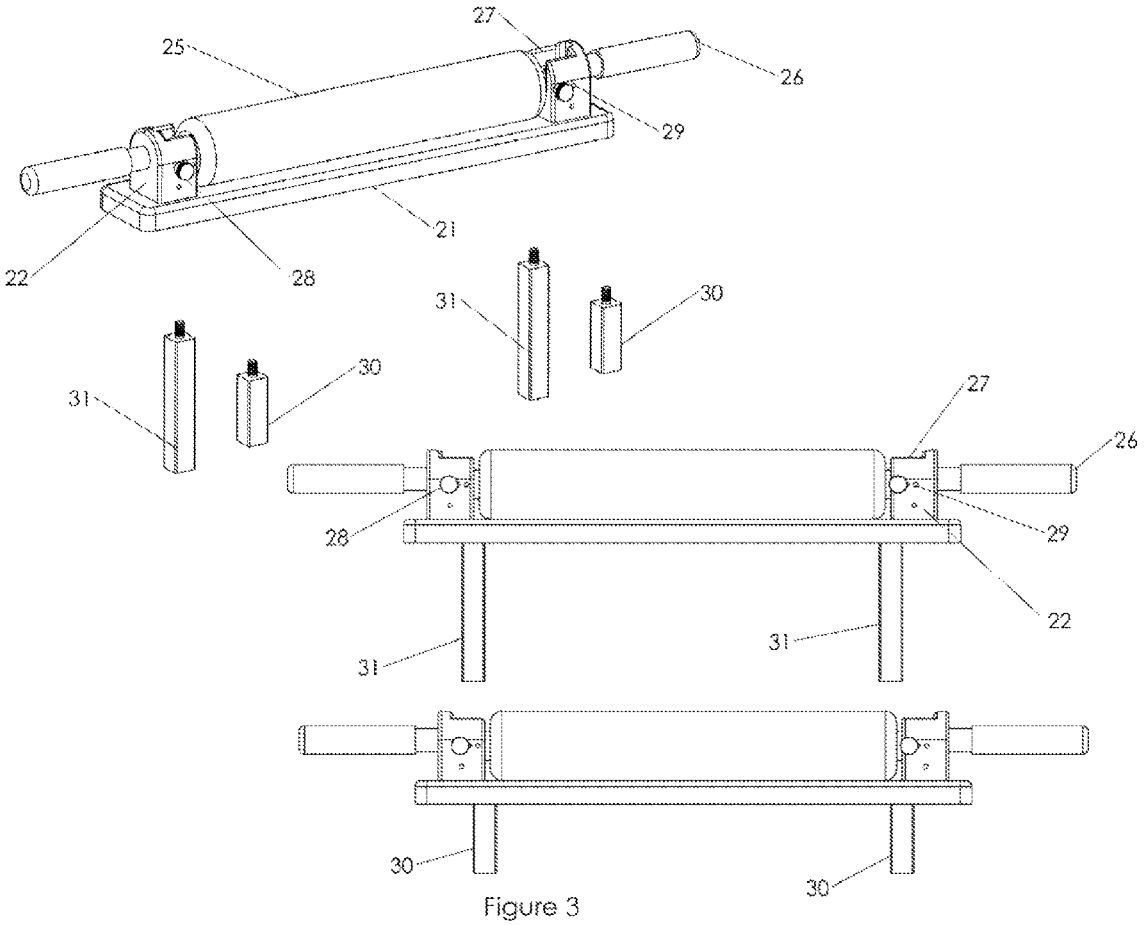
FIG. 3 illustrates perspective and side views of embodiments of reformer base attachment options.

Referring now to FIG. 3, roller barre 20 has the option of coupling with various inserts, for example, the jumpboard inserts 31 or with the shoulder rest inserts 30. Using roller barre 20 in conjunction with an exercise machine eliminates the need for users to lower themselves all the way down to the floor onto a mat in order to use a foam roller. Alternatively, roller barre 20 can be attached to a platform, exercise machine, or any other apparatus configured to reduce stress on joints, muscles, and/or other body parts such as the knees, such as, for example, when repositioning oneself from the machine to a prior art foam roller or to and from the floor. Additionally, having to use a foam roller when on the floor puts additional pressure on the wrist unsuitable for some users, and many users do not have the strength to support their body thus putting additional pressure on the shoulder or wrists. This roller barre 20 reduces stress on joints and body parts because the user does not need to lift his/her own body weight in order to use the foam roller. This may prove to be beneficial when working with clients who are elderly, pregnant, have arthritis, osteoporosis, hypertension, or are enrolled in rehabilitation. Additionally, in some embodiments, the foam roller cannot slip out from underneath the user's body (unlike traditional foam rollers used on the floor) because the rolling bar 24 is cradled into housing cradle 27.

Furthermore, in regards to the wrists and hands, many users do not have the hand strength in both hands in order to securely grip the traditional hand held foam rollers. Roller barre 20 eliminates the need for the user to require the use of both hands in order to roll out the legs and arms.

Eliminating the need of holding onto the handles of a traditional hand held foam roller, allows the user to use the rolling bar 24 for wrist and forearm mobility exercises. Additionally, rolling out the legs and arms reduces the risk of putting the user's shoulders or lower back in a vulnerable position or unsafe range of motion.

In an embodiment, handles 26 are securely attached to roller barre 20, for example, by welds. In an embodiment, handles 26 permit the user to support oneself by means of one's own body weight. Handles 26 can be positioned so that the wrist can be kept in neutral alignment unlike the wrist extension needed in order to perform the same exercise on the floor. In various embodiments, a handle 26 is located on each post 22, for example, a first handle 26 is located on a first post 22 and a second handle 26 is located on a second post 22.

In another embodiment, roller barre 20 is designed to be used in all planes of motion. For example, it can be used while lying supine or prone, side lying, kneeling or crouching, as well as sitting or standing. It can also be used in conjunction with other props such as a mat converter, long box, or platform extender (not shown). Handles 26 can be configured at different angles so as to keeps the wrist neutral. Handle bar grips (not shown) can be added, for example, to maximize grip, prevent slipping, or add additional padding for comfort. Because roller barre 20 can be used sitting or lying on a variety of props, this ensures a more stable pelvic and spinal position when jumpboard inserts 31 are inserted into jumpboard sites. In another embodiment, shoulder rest inserts 30 of roller barre 20 can be inserted into shoulder rest sites. In this embodiment, roller barre 20 may enhance upper thoracic support for users who have weak abdominals or weight issues. For example, such users may rest up against roller barre 20 along with the appropriate density of foam cushioning in order to maintain spinal flexion or assist in abdominal work. Additionally, roller barre 20 along with the appropriate texture of foam roller may provide tactile cues for the neck, shoulders or scapulae while in upper thoracic flexion, otherwise not available when the shoulder rests are in their traditional sites. Furthermore, roller barre 20 can be mounted in any suitable location suitable to facilitate correct alignment during movement or to enhance body safety and injury mitigation.

As previously mentioned, this disclosure seeks to provide a mean of foam rolling that is adaptable for all users regardless of size or physical condition with the intent of encompassing various exercise regression and progressions. In an embodiment, those with common injuries as knees or shoulders may find roller barre 20 beneficial while undergoing physiotherapy by either limiting or increasing their range of motion or resistance when using roller barre 20 with the variable spring tension of the exercise machine. Those recovering from breast cancer surgery may sit on an exercise machine with shoulder rest inserts 30 of roller barre 20 inserted into shoulder rest sites and massage underneath the arm going down the side of the body, allowing the user to control the amount of downward pressure. Those with lymphedema may wish to sit on a long box at the end of the reformer and drape the arm over the rolling bar 24 to massage up the arm up into the armpit to facilitate reduction of retention and the risk of infection.

In an embodiment, prenatal and postnatal users can also benefit from roller barre 20 as it allow for support side-lying and kneeling positions unlike floor foam rollers. For example, many women are encouraged not to lie on their backs after the first trimester and lying on the stomach is difficult due to the developing fetus. Being able to roll out the legs without having to hold onto to handles can improve circulation in the lower body and in one embodiment of the present disclosure, use of roller barre 20 alleviates prior art difficulties such as undesired spinal flexion by eliminating the need to manually hold a rolling bar.

Figure 4:
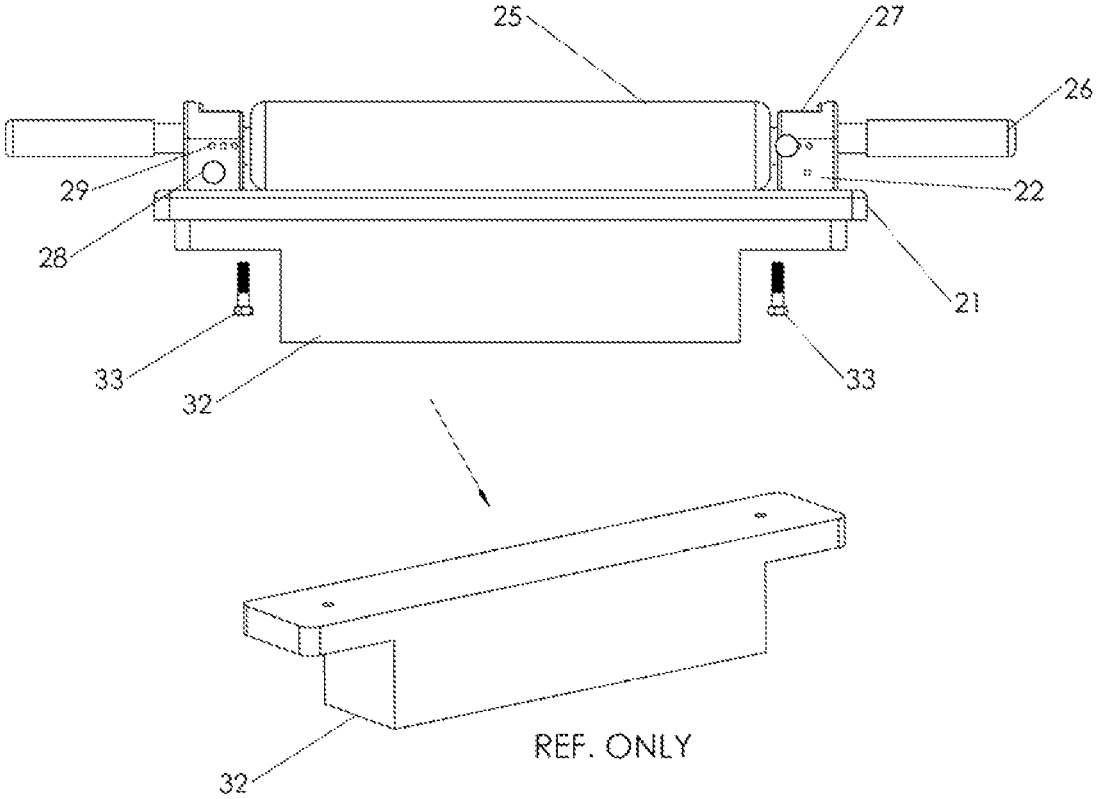
FIG. 4 illustrates side and perspective views of an embodiment of a reformer base attachment option.

Referring now to FIG. 4, in this embodiment, roller barre 20 is shown with yet another possible type of attachment that can be made out of various materials such as wood or metal so that roller barre 20 can be securely attached so that it is able to fit into the jumpboard sites of any exercise machine. Jumpboard insert 32 comprises a flat and wide surface base along with appropriate securing element 33, whereas in FIG. 3, the jumpboard inserts 31 can be square and longer in length to securely attach to another style of exercise machine. Moreover, any attachment configuration adapted to mechanically secure a roller barre 20 to an exercise machine can be used. For example, jumpboard inserts 31 can be longer in length and labeled with numbered securing slots so that roller barre 20 can be elevated to a table top position, provided that full body weight is not loaded onto roller barre 20. This would allow clients who are unable to maintain a table leg top position with one or both legs while lying on the carriage of the reformer to support their legs while still being able to perform such moves as the midback series or the Pilates one hundred. Additionally, when using the longer jumpboard inserts 31, roller barre 20 used in a locked position using the rotational locking pins 28 and degree of rotation inserts 29, can be elevated and used to replace the traditional reformer footbar at the same height to accommodate those who need a larger and/or softer base of support that what is currently offered with the traditional reformer footbar.

While various inserts have been described with reference to FIGS. 3 and 4, persons skilled in the art will readily appreciate that base 21 can be coupled to an exercise machine in any suitable manner, whether with or without one or more inserts, and whether temporarily or permanently. For example, base 21 can be coupled to an exercise machine via bolts, dowels, welding, soldering, brazing, sleeves, brackets, clips or other means known in the art or hereinafter developed.

Thus in accordance with various embodiments, an exercise system may comprise a roller barre device, and an exercise machine wherein the roller barre device and the exercise machine are connected in mechanical communication. In various embodiments, the exercise machine is a Pilates reformer.

Figure 5:
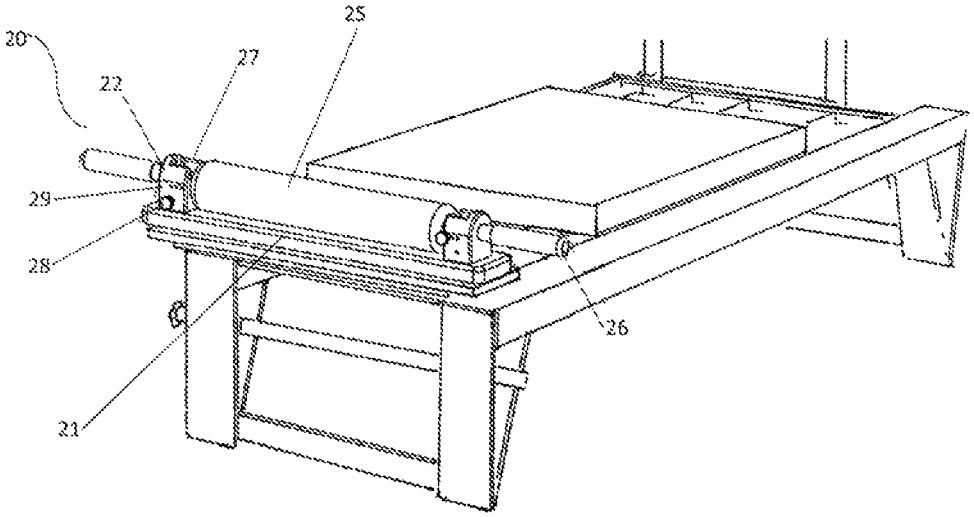
FIG. 5 illustrates an embodiment of the present disclosure inserted into the jumpboard site with no foot rest.
Figure 6:
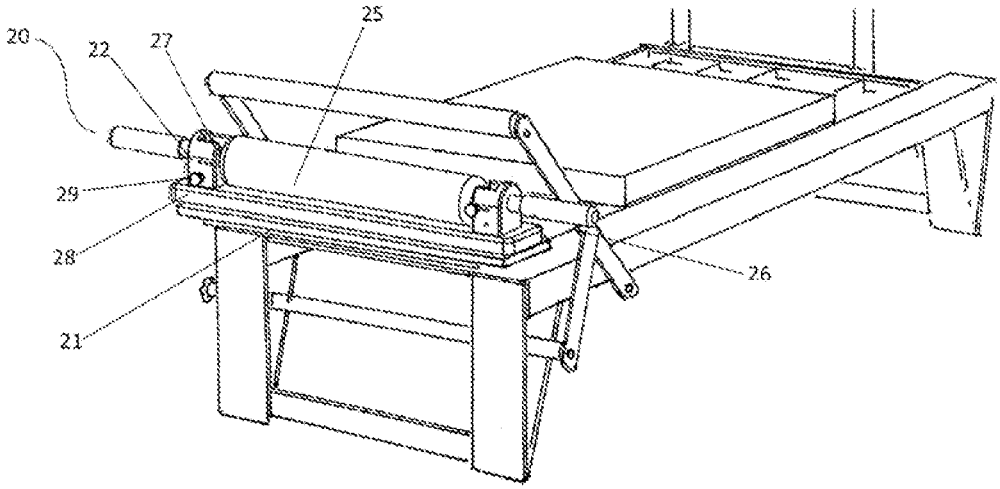
FIG. 6 illustrates an embodiment of the present disclosure inserted into the jumpboard site with foot rest up.
Figure 7:
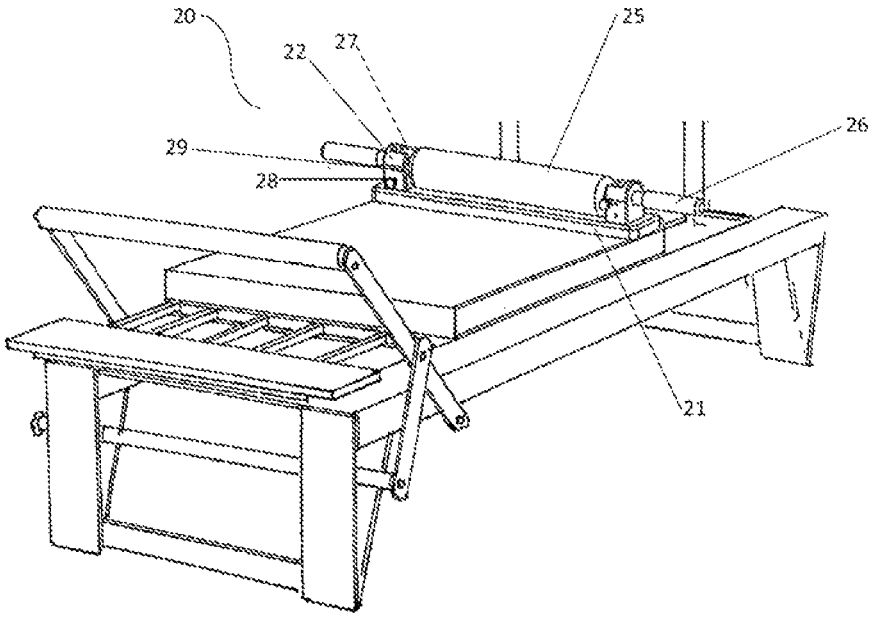
FIG. 7 illustrates an embodiment of the present disclosure inserted into the shoulder rest sites.

Referring to FIGS. 5, 6, and 7, existing exercise machine users will appreciate the simplicity of roller barre 20 and how they are able to work in different planes of motion but in manner that challenges their level of fitness. For example, FIG. 5 shows an embodiment of roller barre 20 wherein roller barre 20 is attached to the jumpboard inserts 31 of an exercise machine with the reformer footbar in the down position. The jumpboard inserts 31 can be screwed into base 21 at the opposing distal ends of the jumpboard inserts 31. Attaching the appropriate amount of spring tension in this configuration, may, for example, permit all fitness levels to perform self-myofascial release by facilitating use of the rolling bar 24 along with the appropriate foam roller 25 as the rolling bar 24 rotates around the support rod 23 inside the housing cradles 27 to massage the bottom of the foot (working the superficial back line) yet allow various fitness levels work at different intensities adding more body weight resistance or balance. The beginner user may choose to sit on the carriage (with or without platform extender), maintaining a neutral spine, while rolling out the bottom of the feet along rolling bar 24. The intermediate user may perform a similar plantar fascia release but may move to a semi-lunge (kneeling on one knee) position with one foot on rolling bar 24, one knee on the carriage in front of 20, with hands on 26. To increase strength, the advanced user would then push away against the spring tension, lifting the knee of the carriage and lengthening out the leg. Maintaining balance and alignment, the user would then proceed to roll out the bottom of the forward foot on rolling bar 24. To work while balanced in a standing position, the user of any fitness level would move a platform extender in front of roller barre 20, stand up with both feet on the platform extender, lift one foot up and place it on top of rolling bar 24 and proceed to roll out the bottom of the foot while challenging balance, stability and neutral alignment. As previously mentioned, roller barre 20 used in conjunction with longer jumpboard inserts 31 and elevated to the same height as a reformer footbar, can be used as a replacement for the traditional footbar for clients requiring a softer surface, or for those who are trying to work on ankle stabilization during footwork exercises or holding exercises. A person having ordinary skill in the art will recognize that any structure adaptable for attaching roller barre 20 to an exercise machine can be implemented.

Referring again to FIG. 5, jumpboard inserts 31 of with roller barre 20 attached into jumpboard sites, skilled exercise machine users can enjoy the challenge of increasing their stability while using roller barre 20 instead of the traditional footbar to perform exercises like hip rolls prep or hip rolls. Additionally, by installing the mat converter (not shown) which replaces or covers up the sliding carriage of a reformer and provides a flat and stable cushioned surface, essentially transforming the reformer into a mat or a trapeze table, along with roller barre 20, mat exercises like shoulder bridge prep with one leg slightly lifted and shoulder bridge make the exercises more challenging by having to stabilize that leg as it tries not to roll rolling bar 24. Abdominal exercises like ab prep, half roll back, and obliques roll back can also be performed on either the carriage or mat converter while stabilizing on rolling bar 24. Pushups may also be done on roller barre 20 either by using the handles 26 or coming off the reformer and placing one hand on rolling bar 24 and the other on the exercise machine, such as on the carriage. Having one hand on rolling bar 24 challenges joint stability and balance as well. In these configurations, a user can perform an even greater number of exercises.

Referring now to FIG. 6, this figure shows jumpboard inserts 31 of roller barre 20 attached into the jumpboard sites with the exercise machine footbar in the up (highest) position. To work the fascia of the superficial back line, users may lie supine in neutral alignment on the carriage with the desired spring tension, with one foot on top of the footbar with knee flexed and the other foot underneath the footbar resting on top of rolling bar 24 with knee extended. By pressing into the footbar and extending the flexed knee the carriage will push away from roller barre 20 causing the back of the leg to roll along rolling bar 24 releasing the fascia along the Achilles tendon and gastrocnemius. In addition to the self-myofascial release the user is receiving, the user is also working unilaterally on the one leg, concentrically and eccentrically through the quadriceps and the hamstrings. The position of the ankle on the footbar (e.g., heels on bar, high half toe, etc.) may also emphasize different muscles in the working leg. In order to release the lateral line, the user may then choose to add a block under the head and roll onto one side of the body in neutral alignment. With the top leg pressing into the footbar and the bottom leg on top of rolling bar 24, the user begins to working the top leg in the sagittal plane (flexion and extension) while performing self-myofascial release along the peroneals, the anterior ligament of head of fibula, and into the iliotibial tract. By working unilaterally, the user is able to strengthen and lengthen out a particular area of the body without creating any unnecessary tension in other areas of the body while still maintaining neutral alignment and ensuring safety.

The physical and mechanical structure of roller barre 20 allows the aforementioned process to take place because it is fixed into position just behind the footrest of the exercise machine, anchored by two jumpboard inserts 31 that fit into the jumpboard sites near the end of the reformer. Although the roller barre is in a fixed position the rolling bar 24 is not fixed and is free to spin (axially rotate) around the support rod 23 inside of the housing cradles 27. The strengthening of the muscles within the top leg occurs when the user adds the spring tension of the exercise machine which is located just below the footbar and presses away from roller barre 20. The muscles and fascia of the bottom leg are able to lengthen when they roll across the top of the rolling bar 24 with the desire type of foam roller as the reformer carriage moves back and forth rotating 24 within the housing cradles 27.

With reference to FIG. 7, shown is shoulder rest inserts 30 of roller barre 20 inserted into the shoulder rest sites. The traditional mat shell stretch exercise can now be done on the reformer with the addition of roller barre 20. Kneeling on the carriage with weight back towards the heels facing roller barre 20, arms lengthened out in front towards roller barre 20, resting on rolling bar 24. By rolling the arms along rolling bar 24, one is able to work the fascia of the deep and superficial front arm lines all while stretching the latissimus dorsi, lower back, and gluts. This same arm movement may also be done from the side allowing the arm to reach down on an angle to the floor. As previously mentioned, positioning roller barre 20 into the shoulder rest inserts 30 may help larger clients or those with weaker abdominal muscles to maintain flexion of the spine. Additionally, by resting any area of the back/spine along rolling bar 24 and pressing and holding into the roller adds an element of myofascial compression technique.

In accordance with certain embodiments, the present disclosure includes kits. In addition to a roller barre as described supra, a kit may comprise DVDs, instructional manuals, or programming exercises.

Now having described various aspects of a roller barre, in accordance with various embodiments a roller barre may be assembled according to various steps. A method of assembling a roller barre device may comprise assembling a roller, wherein said assembling comprises inserting a support rod into a first rolling bar, wherein the first rolling bar comprises an aperture wherein the support rod may be inserted. The roller may be positioned in mechanical communication with a first post comprising a first housing cradle and a second post comprising a second housing cradle, wherein the first post and the second post are affixed to a base, and wherein the roller is positioned in the first housing cradle and the second housing cradle. At least one insert may be attached in mechanical communication with the base, and the insert may be attached to an exercise machine. Assembling a roller may further comprise inserting the support rod into a second rolling bar, wherein the second rolling bar comprises an aperture wherein the support rod may be inserted.

Moreover, assembling a roller barre device may include attaching handles in mechanical communication with the posts, for example, by welding.

Furthermore, assembling a roller barre device may include inserting a first rotational locking pin into the first post whereby the roller may be securely mounted in position, placing a rotation limiting insert in the first housing cradle of the first post, and thus limiting the degree of rotation of the first rolling bar. In various embodiments, assembling a roller barre device may include inserting a first rotational locking pin into the first post whereby the first rolling bar may be securely mounted in position, placing a rotation limiting insert in the first housing cradle of the first post, and thus limiting the degree of rotation of the first rolling bar, inserting a second rotational locking pin into the second post whereby the second rolling bar may be securely mounted in position, and placing a rotation limiting insert in the second housing cradle of the second post, thus limiting the degree of rotation of the second rolling bar.

It will be apparent to those skilled in the art that various modifications and variations can be made in the present disclosure without departing from the spirit or scope of the disclosure. Thus, it is intended that the embodiments described herein cover the modifications and variations of this disclosure.

Numerous characteristics and advantages have been set forth in the preceding description, including various alternatives together with details of the structure and function of the devices and/or methods. The disclosure is intended as illustrative only and as such is not intended to be exhaustive. For example, while the present disclosure has been described primarily with reference to a Pilates reformer, persons skilled in the art will readily appreciate that the present disclosure is not so limited, but can be more broadly applied to any exercise machine, as that term has been defined herein. While the principles of this disclosure have been shown in various embodiments, many modifications of structure, arrangements, proportions, the elements, materials and components, used in practice, which are particularly adapted for a specific environment and operating requirements can be used without departing from the principles and scope of this disclosure. These and other changes or modifications are intended to be included within the scope of the present disclosure and can be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "proximate," "proximately," or any other variation thereof, are intended to cover a physical connection, an electrical connection, a magnetic connection, an optical connection, a communicative connection, a functional connection, and/or any other connection. When language similar to "at least one of A, B, or C" is used, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A roller barre device comprising:

a base;

a first roller bar comprising first rotational threads disposed at a distal end of the first roller bar;

a second roller bar coaxial with the first roller bar and comprising second rotational threads disposed at a distal end of the second roller bar;

a first post affixed to the base and comprising:

a first rotational locking pin interactive with the first rotational threads whereby a degree of rotation of the first roller bar may be adjustably limited independently of the second roller bar; and a second post affixed to the base and comprising:

a second rotational locking pin interactive with the second rotational threads whereby a degree of rotation of the second roller bar may be adjustably limited independently of the first roller bar;

wherein the first roller bar and the second roller bar are independently rotatable.

2. The roller barre device of claim 1, wherein the first rotational threads comprise:

a first myofascial compression position thread comprising an aperture disposed through the first roller bar and configured to receive the first rotational locking pin, whereby the degree of rotation of the first roller bar is restricted to about zero degrees;

a first rehabilitation compression position thread comprising a channel disposed through the first roller bar and configured to receive the first rotational locking pin, whereby the degree of rotation of the first roller bar is restricted to no more than 90 degrees and no less than 45 degrees; and a first advanced compression position thread comprising a channel disposed through the first roller bar and configured to receive the first rotational locking pin, whereby the degree of rotation of the first roller bar is restricted to no more than 360 degrees and no less than 180 degrees, and wherein the second rotational threads comprise:

a second myofascial compression position thread comprising an aperture disposed through the second roller bar and configured to receive the second rotational locking pin, whereby the degree of rotation of the second roller bar is restricted to about zero degrees;

a second rehabilitation compression position thread comprising a channel disposed through the second roller bar and configured to receive the second rotational locking pin, whereby the degree of rotation of the second roller bar is restricted to no more than 90 degrees and no less than 45 degrees; and a second advanced compression position thread comprising a channel disposed through the second roller bar and configured to receive the second rotational locking pin, whereby the degree of rotation of the second roller bar is restricted to no more than 360 degrees and no less than 180 degrees.

3. The roller barre device of claim 1, wherein the first post further comprises a first housing cradle, wherein the second post further comprises a second housing cradle, and wherein the first roller bar and the second roller bar fit within the first housing cradle and the second housing cradle, respectively, thereby being maintained in mechanical communication with the first post and the second post.

4. The roller barre device of claim 1, wherein the first rotational locking pin is disposed thru a first rotation limiting insert whereby the first roller bar may be securely mounted in position, and wherein the second rotational locking pin is disposed thru a second rotation limiting insert whereby the second roller bar may be securely mounted in position.

5. The roller barre device of claim 2, wherein the first roller bar comprises foam.

6. The roller barre device of claim 1, further comprising at least one insert connected in mechanical communication with the base and extending substantially normal to a plane of the base whereby the device may be attached to an exercise machine.

7. The roller barre device of claim 6, wherein the at least one insert is removable.

8. The roller barre device of claim 1, wherein the first roller bar and the second roller bar are associated with a first support rod.

9. The roller barre device of claim 1, further comprising a handle.

10. The roller barre device of claim 1, further comprising:

a first handle attached in mechanical communication with the first post; and a second handle attached in mechanical communication with the second post.

11. The roller barre device of claim 3, wherein the first housing cradle and the second housing cradle each opens in a direction normal to a surface plane of the base.

12. The roller barre device of claim 3, wherein the first housing cradle and the second housing cradle each opens in a direction parallel to a surface plane of the base.

13. The roller barre device of claim 1, wherein the base further comprises high traction grip pads.

14. A roller barre device comprising:

a base;

a first roller bar;

a second roller bar coaxial with the first roller bar;

a first post affixed to the base and configured to be interactive with the first roller bar whereby a degree of rotation of the first roller bar may be adjustably limited independently of the second roller bar; and a second post affixed to the base and configured to be interactive with the second roller bar whereby a degree of rotation of the second roller bar may be adjustably limited independently of the first roller bar, wherein the first roller bar and the second roller bar are independently rotatable.

15. The roller barre device of claim 14, wherein the degree of rotation of the first roller bar may be adjustably limited to at least one of:

a first myofascial compression position whereby the degree of rotation of the first roller bar is restricted to about zero degrees;

a first rehabilitation compression position whereby the degree of rotation of the first roller bar is restricted to no more than 90 degrees and no less than 45 degrees; and a first advanced compression position, whereby the degree of rotation of the first roller bar is restricted to no more than 360 degrees and no less than 180 degrees.

16. The roller barre device of claim 14, wherein the first post comprises a first housing cradle, wherein the second post comprises a second housing cradle, and wherein the first roller bar and the second roller bar fit within the first housing cradle and the second housing cradle, respectively, thereby being maintained in mechanical communication with the first post and the second post.

17. The roller barre device of claim 14, wherein the first roller bar and the second roller bar each comprises an aperture wherein a first support rod is inserted.

* * * * *